US008277303B2

(12) United States Patent
Duhamel et al.

(10) Patent No.: US 8,277,303 B2
(45) Date of Patent: Oct. 2, 2012

(54) METHOD OF OPERATING AND DISPLAYING A METER FEATURE USING EVOLVING SYMBOLS IN A LINE GAME

(75) Inventors: Gérald Duhamel, Drummondville (CA); Marie-Claude Gagnon, Drummondville (CA)

(73) Assignee: Labtronix Concept, Drummondville, QC (CA)

( * ) Notice: Subject to any disclaimer, the term of this patent is extended or adjusted under 35 U.S.C. 154(b) by 1059 days.

(21) Appl. No.: 10/811,498

(22) Filed: Mar. 29, 2004

(65) Prior Publication Data

US 2005/0143164 A1 Jun. 30, 2005

Related U.S. Application Data

(60) Provisional application No. 60/457,704, filed on Mar. 27, 2003.

(51) Int. Cl.
*A63F 9/24* (2006.01)

(52) U.S. Cl. ..... 463/20; 463/16; 463/22; 463/25; 273/143 R

(58) Field of Classification Search ..... 463/16, 463/20, 22, 25, 30, 31; 273/143 R
See application file for complete search history.

(56) References Cited

U.S. PATENT DOCUMENTS

| | | | | |
|---|---|---|---|---|
| 4,570,934 | A | 2/1986 | Smyth | |
| 4,669,731 | A | 6/1987 | Clarke | |
| 5,123,649 | A | 6/1992 | Tiberio | |
| 5,580,309 | A | 12/1996 | Piechowiak et al. | |
| 5,639,088 | A | 6/1997 | Schneider et al. | |
| 5,695,402 | A | 12/1997 | Stupak | |
| 5,833,537 | A * | 11/1998 | Barrie | 463/21 |
| 6,004,207 | A | 12/1999 | Wilson, Jr. et al. | |
| 6,056,642 | A | 5/2000 | Bennett | |
| 6,203,430 | B1 | 3/2001 | Walker et al. | |
| 6,659,867 | B1 * | 12/2003 | Kodachi et al. | 463/20 |
| 6,780,109 | B2 * | 8/2004 | Kaminkow | 463/20 |
| 2002/0052233 | A1 | 5/2002 | Gauselmann | |
| 2003/0157978 | A1 * | 8/2003 | Englman | 463/16 |
| 2005/0239532 | A1 * | 10/2005 | Inamura | 463/16 |

OTHER PUBLICATIONS

Brokopp, John, "New Slots Send Up Caution Flag", Casino City Times, Aug. 2, 1999, <http://brokopp.casinocitytimes.com/articles/545.html>.

* cited by examiner

*Primary Examiner* — Dmitry Suhol
*Assistant Examiner* — Brandon Gray
(74) *Attorney, Agent, or Firm* — Benoît & Côté

(57) ABSTRACT

Method of operating a line game wherein the values of a meter are displayed as different statuses of an evolving symbol. The meter gathers symbols, combinations of symbols, events that are dependent of the game outcome (like winning or losing outcomes, prizes, etc.), or events that are independent of the game outcome (like spins, bet values, lengths of time, etc.). The evolving symbol statuses are used in the line game to trigger features ranging from a wild symbol to a bonus payout which can take the form of a progressive jackpot.

13 Claims, 11 Drawing Sheets

| Meter symbol | Meter Thresholds (20) | | | Prize Value |
|---|---|---|---|---|
| | 1 | 2 | 3 | |
| 22 Any | | | | 1 |
|  | 0 | 0 | 0 | 1 |
|  | 5 | 4 (21) | 5 | 2 |
|  | 10 | 9 | 9 | 3 |
|  | 14 | 15 | 14 | 5 Wild |
|  | 20 | 20 | 20 | Bonus |

30

| Meter symbol | Meter Thresholds | | | Prize Value per unit |
|---|---|---|---|---|
| | 1 | 2 | 3 | |
|  | 0 | 0 | 0 | 1 |
|  | 9 | 4 | 5 | 2 |
|  | 16 | 10 | 9 | 3 |
|  | 23 | 15 | 19 | 5 Wild |
|  | 25 | 25 | 25 | 5 Wild Bonus |

| Meter symbol | Meter Thresholds 1 | 2 | 3 | Value |
|---|---|---|---|---|
|  | 0 | 0 | 0 | 41 → 1 |
|  | 9 | 4 | 5 | 40 → Wild |
|  | 16 | 10 | 9 | Wild X2 |
|  | 23 | 15 | 19 | Wild X3 |
|  | 25 | 25 | 25 | Wild X5 |

| Meter symbol | Value |
| --- | --- |
|   | - |
|  | Wild |
|  | Wild X2 |
|  | Wild X3 |
|  | Wild X5 Jackpot |

45 Evolution End Threshold : 25

| Meter symbol | Meter Thresholds | Value |
|---|---|---|
|   | 1 | 1 |
|  | 60 6 | 1 |
|  | 10 | 2 |
|  | 17 | 4 |
|  | 25 | 61 Wild Enhanced Pay |

METHOD OF OPERATING AND DISPLAYING A METER FEATURE USING EVOLVING SYMBOLS IN A LINE GAME

CROSS-REFERENCE TO RELATED APPLICATIONS

This application claims priority under 35USC§119(e) of U.S. Provisional Patent Application Ser. 60/457,704, filed on Mar. 27, 2003 and entitled METER SYMBOLS, the specification of which is hereby incorporated by reference.

TECHNICAL FIELD

The present invention relates to the operation and display of a meter feature using evolving symbols in a line game.

BACKGROUND OF THE INVENTION

Line games are among the most popular games in the gaming industry. The diversity of themes, schemes and bonuses they offer is probably the key reason for their popularity. They are entertaining and easy to play; even though the player does not know all the rules, he still can enjoy the game and his chances of winning are not diminished.

One of the features already popular in line games is the meter; by gathering symbols or combination of symbols, the meter triggers second-screen bonuses, free spins, special prizes, or any other feature. Usually, the meter consists in a value increasing throughout the game with the accumulation of a symbol or event, and is displayed as a number, a gathering of objects on a screen or as a graphical representation, like a thermometer. When the meter reaches a target value, a feature is automatically triggered. An example of a game using a meter having a graphical representation is IGT's "Wild Cherry Pie" game; the cherries appearing on the reels are gathered in a pie drawing displayed over these reels. When a section of the pie is full of cherries, an instant bonus prize is awarded to the player. Upon completion of the pie, the player is taken to a second screen bonus. This meter feature has no influence on the primary game payout or on the probability of winning in said primary game.

Another feature is to modify some symbol characteristics, such as its appearance, properties, prize value, etc. Manufacturers have used this feature in many ways. U.S. Pat. No. 6,059,642 describes a game wherein, upon occurrence of a winning outcome, a second random number generator determines a color for the background of each symbol participating to the winning outcome. If the symbols participating to the winning outcome are all of the same color, a bigger prize is awarded to the player. Another way to use the symbol modification feature is described in U.S. patent application Ser. No. 20020052233: the occurrence of a wild symbol at a predetermined position triggers the modification of the symbols displayed on the same reel. These modifications are linked to the current spin or play only and do not have any influence on the payout or the probability of winning of subsequent spins or plays.

Improvements in such line games are desired to keep players interested.

SUMMARY OF THE INVENTION

An object of the invention is to use a meter to gather occurrences of different events, like the occurrence of a predetermined symbol or combination of symbols. Events dependent of the game outcome (winning outcome, losing outcome or prize value), or independent of the game outcome (spin, elapsed length of time or bet value) are also events that may be gathered by the meter.

Another object of the invention is to evolve Evolving Symbol Units (ESUs) all at the same rate or independently one from the other.

A further object of the invention is to evolve all ESUs at the same time or to evolve only a portion of them.

A last object of the invention is to use the evolving symbol statuses to trigger features in the line game, some possible features being a change in the evolving symbol prize value, a new pay table, a bonus payout, a wild feature, an on-screen bonus or a second-screen bonus.

In accordance with an embodiment of the invention, there is provided a method of operating a line game wherein values of a meter are displayed as different statuses of an evolving symbol. These statuses are used in the line game to trigger at least one feature. Thus, the meter feature has an influence on the line payout or on the probability of winning in said line game.

In accordance with another embodiment of the invention, there is provided a game apparatus comprising a meter gathering occurrences of a predetermined event. The game apparatus further comprises a display controller displaying the meter as different statuses of an evolving symbol, according at least in part to a value of the meter. Finally, the game apparatus comprises an evaluation means triggering a feature in a line game wherein at least one of the statuses is used in the line game to trigger the feature.

In accordance with an yet another embodiment of the invention, there is provided a computer program embodied on a computer readable medium having codes adapted to gather occurrences of a predetermined event in a meter; and display the meter as different statuses of an evolving symbol; wherein at least one of the evolving symbols is used in a line game to trigger a feature.

In accordance with still another embodiment of the invention, there is provided a computer program carried on an electrical or electromagnetic carrier signal having codes adapted to gather occurrences of a predetermined event in a meter; and display the meter as different statuses of an evolving symbol; wherein at least one of the evolving symbol is used in a line game to trigger a feature.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENTS

Figure 1:
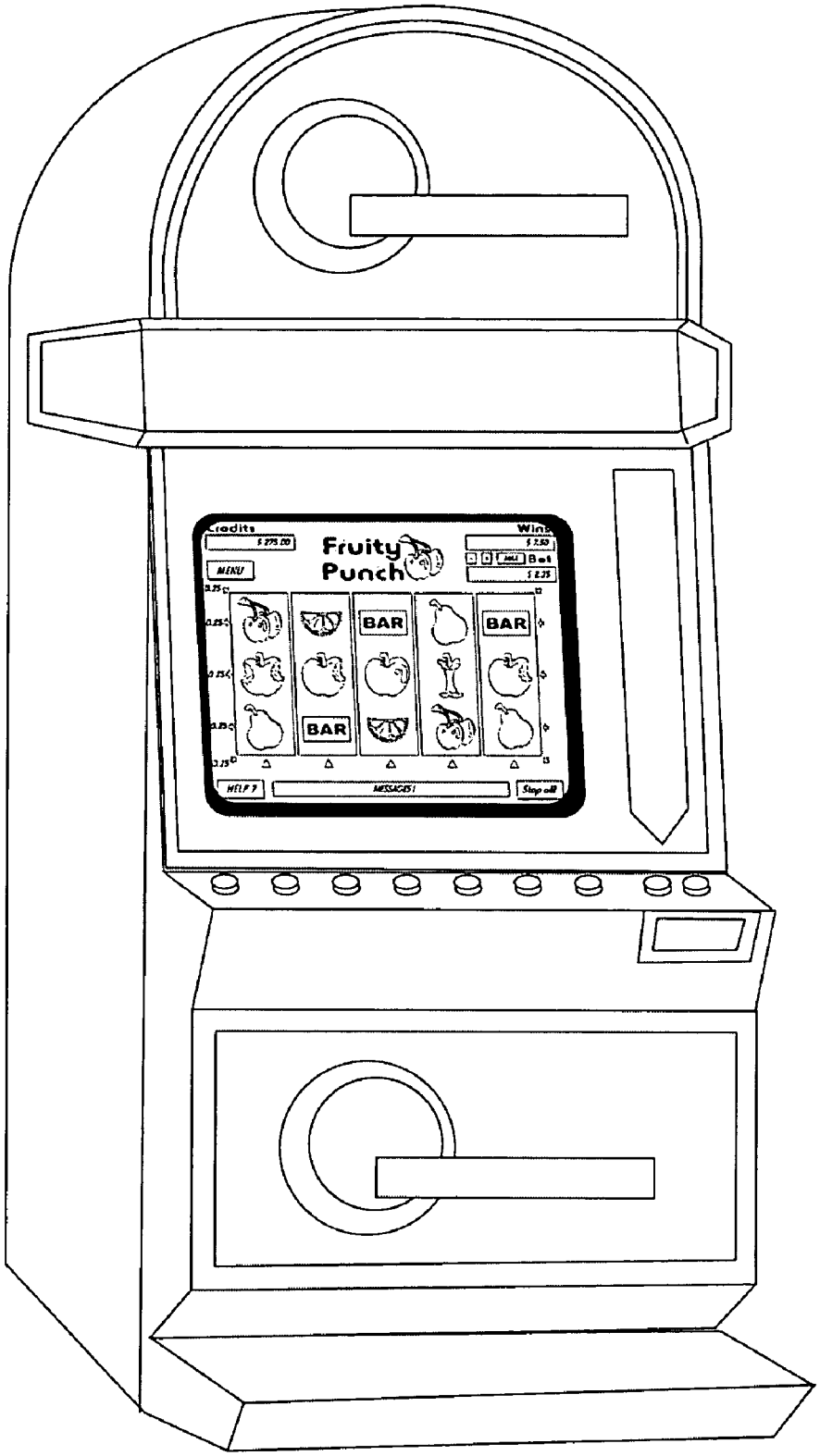
FIG. 1 is a representation of a gaming machine used to play a game in application with an embodiment of the present invention.
Figure 2:
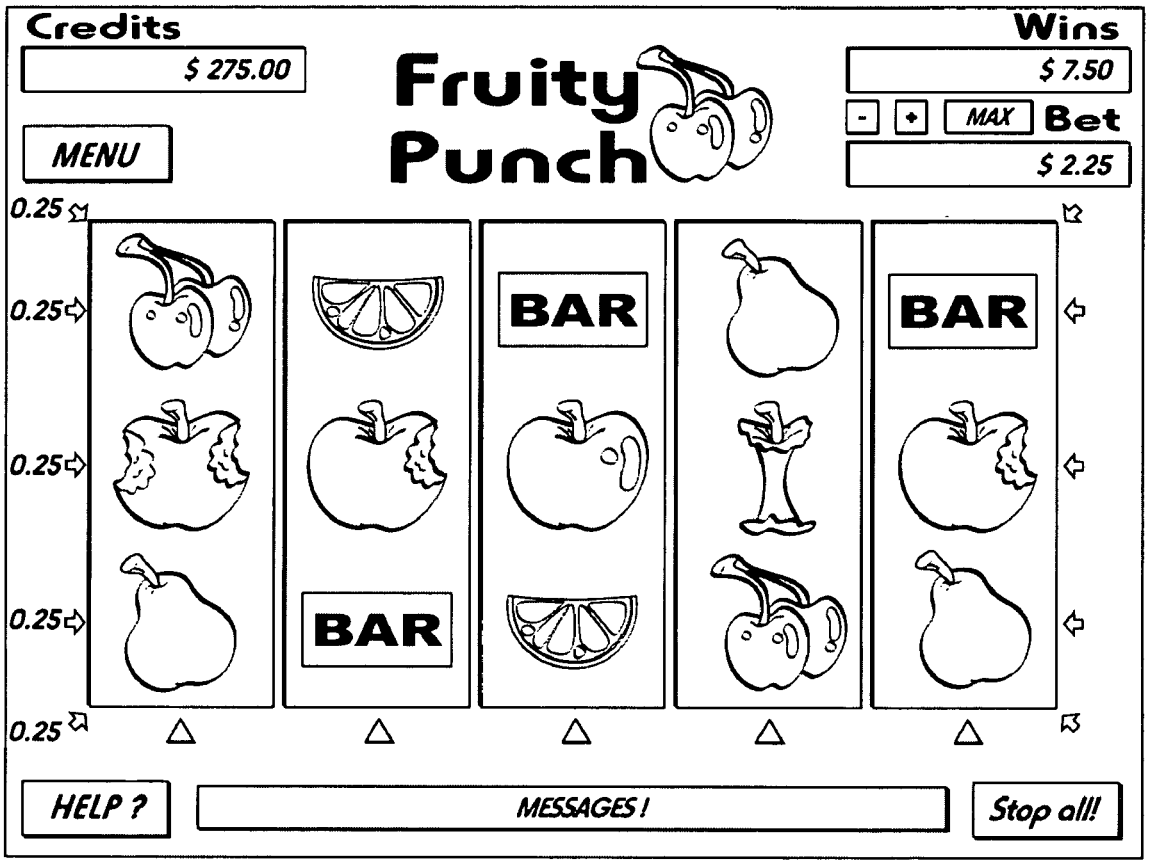
FIG. 2 is a screen shot of a game in application with an embodiment of the present invention.
Figure 3:
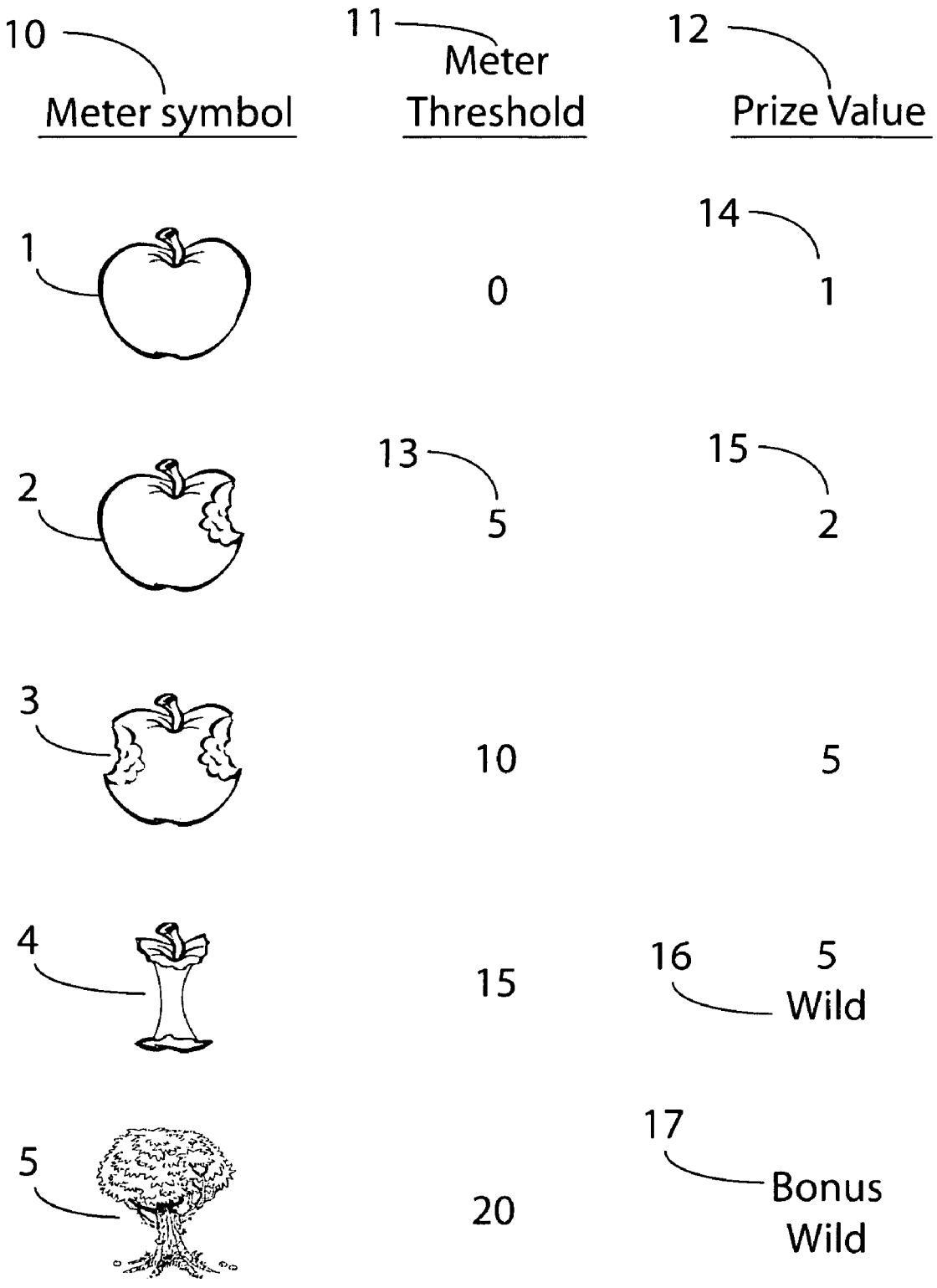
FIG. 3 is an evolving symbol pay table for a game applying an embodiment of the present invention.

This invention preferably consists in a gaming machine, as illustrated on FIG. 1, offering a line game as a primary game, as shown on FIG. 2, or as a bonus game. The line game uses a meter displayed as an evolving symbol, the appearance of which depends in part on the value of the meter. An evolving symbol has multiple statuses or appearances that are preferably instinctively perceived as evolving by the player. As shown in FIG. 3, a preferred embodiment of such a symbol is an apple having the following statuses: Whole Apple 1, Apple One Bite 2, Apple Two Bites 3, and an Apple Core 4. An Apple Tree 5 symbol can also be added to the sequence to trigger a second-screen bonus. Another example of an evolving symbol is a colour-changing symbol. Since the player knows the colour sequence, the evolution is easily followed. One of the preferred symbols in line games is the "7". The "7" symbol can evolve from white, to red, to blue, to white/red/blue, to silver, and finally to gold. Preferably, a line of blue "7's" would pay more than a line of white "7's".

The evolving symbols change for the subsequent status, or evolve, upon occurrence of an evolution trigger. In most of the preferred embodiments, the evolution is triggered when the meter reaches a predetermined threshold.

The meter is used to gather occurrences on the screen of predetermined events, said events being dependent or independent of the game outcome. Usually, the meter is used to gather occurrences on the screen of a predetermined symbol or of a predetermined combination of symbols, such as a winning combination or any combination of at least two (2) predetermined symbols. Winning or losing outcomes as well as won prize values are some other outcome dependent events that may be gathered by the meter. This meter may also be used to gather outcome independent events, like spins (a unit is added to the meter each time the player pushes the button "Play"), elapsed lengths of time (the meter is in fact a chronometer which measures the time of play, starting when the player inserts his player card or puts money in the machine, and stopping when the player cashes out his money or card, for example), or bet values (a unit is added to the meter for each credit wagered during the game). In some embodiments, the meter is reset to zero when the player cashes out his money or removes his card, but it can also be reset when the final feature is triggered.

Even though most disclosed embodiments have only one meter and thus only one evolving symbol, it is possible to use more than one meter to monitor more than one event. For example, a meter gathers the occurrences on the screen of a predetermined symbol while another meter gathers losing outcomes to keep the player interested in case of losing streaks.

To display the meter in an interesting way, the evolving symbol appears at least once on at least one reel, and this at any of its statuses. Each occurrence of the evolving symbol is identified as an Evolving Symbol Unit (ESU). For example, on a reel bearing three (3) ESUs, these ESUs may appear as one Whole Apple and two (2) Apples One Bite at one moment and as one Apple Two Bites, one Apple Core, and one Apple Tree, later in a play session. All examples and illustrations of the present invention given here comprise three units of each evolving symbol on each of three reels. However, the invention could easily apply to games having a different number of ESUs and/or reels.

A simple embodiment of this invention is a global and uniform evolutions, i.e., all ESUs evolve at the same time and at the same rate. FIG. 3 illustrates the evolution of each ESU for such an embodiment. The first column 10 illustrates the evolution of the ESUs appearance or status while the second 11 displays the meter thresholds or goal values. For example, a game has a meter gathering the occurrences of a predetermined symbol different from the evolving symbol. On the first spin, there are two gathered symbol units on the screen; the meter takes a value of two. There is no evolution since the evolution trigger threshold is five (5) 13. On the second spin, only one gathered symbol unit appears on the screen and one unit is added to the meter, taking it to three. Still no evolution since the threshold 13 has not been reached. The fourth and sixth spins each comprise a gathered symbol unit, which takes the meter to the threshold of five (5). Upon occurrence of the evolution trigger, all ESUs of the game change their status or appearance from a Whole Apple to an Apple One Bite. Until that moment, when a line of apples (Whole Apples) was formed on the screen, the player was awarded a prize of one (1) credit, according to the prize value of a line of Whole Apple 14 of the third column 12. However, until the next evolution trigger, the player is awarded two (2) credits for each line of apples (Apples One Bite) 15 he gets. The new status has triggered a raise in the prize value associated with the evolving symbol. When the meter reaches a threshold of fifteen (15) units, the apple (Apple Core) becomes a wild symbol 16, replacing any other symbol to raise the chances of winning. A line of apples (Apple Cores) awards five (5) credits to the player. The meter stops gathering new occurrences of the gathered symbol when it reaches its final threshold at twenty (20), upon which the apples become Apple Trees. Not only the Apple Trees are also wild symbols but a line of Apple Trees triggers a second-screen bonus 17, according to the third column 12 of the table. Back in the primary game, the meter is reset to zero and all the ESUs return to the initial status, the Whole Apple.

Figure 4:
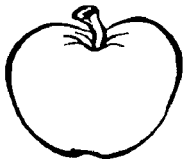
FIG. 4 is an evolving symbol pay table for a simple embodiment of the present invention.
Figure 4:
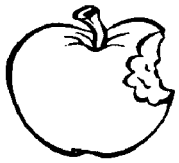
Figure 4:
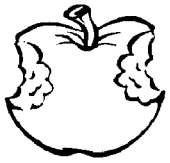
Figure 4:
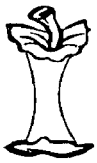
Figure 4:
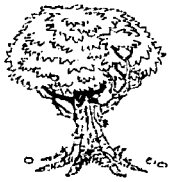

Another embodiment is to associate a plurality of thresholds to a plurality of groups of ESUs. A preferred embodiment is to determine, for each reel, a set of thresholds and thus associated a reel with its own set of evolution triggers. FIG. 4 shows a pay table for such an embodiment. The second column 20 illustrates the meter thresholds for each reel. Since there are three reels in this example, there are three sets of meter thresholds 20. When a threshold for a reel is reached, all ESUs of this reel evolve. For example, upon gathering four (4) gathered symbol units, the ESUs of the second reel 21 evolve to the subsequent status, the Apple One Bite. The ESUs of the other two reels remain at the Whole Apple status. The player can now get lines formed of at different apple statuses. These lines are identified as Any Apples 22 in the pay table and award only one (1) credit to the player. When the player gets an Apple Tree on the screen, he selects it and a bonus award is revealed. If a line of Apple Trees is formed, each Apple Tree bonus award is doubled.

Figure 5:
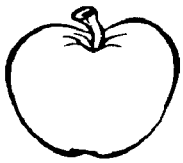
FIG. 5 is an alternate evolving symbol pay table for a game wherein each reel has its own set of evolution triggers.
Figure 5:
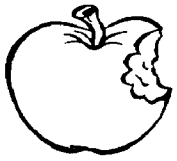
Figure 5:
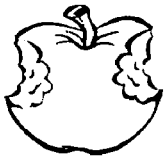
Figure 5:
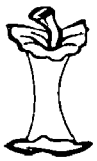
Figure 5:
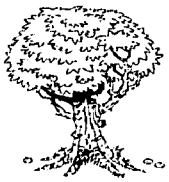

FIG. 5 illustrates another example of such an embodiment. In this example, the prize values 30 are awarded for each individual apple participating in a winning combination.

Thus having a line formed by an Apple Core, an Apple Two Bites and an Apple Tree would award thirteen (5+3+5=13) credits to the player.

Figure 6:
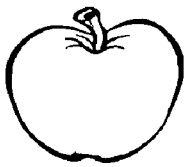
FIG. 6 is an evolving symbol pay table for a game wherein the Evolving Symbol Units (ESUs) are used as multipliers.
Figure 6:
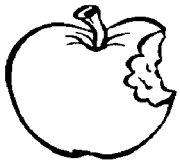
Figure 6:
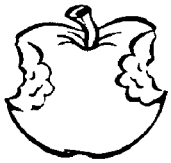
Figure 6:
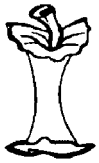
Figure 6:
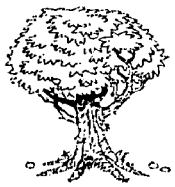

A final example for this embodiment is to associate multiplier values to the evolving symbol statuses, as shown on FIG. 6. After becoming a wild symbol at the Apple One Bite status 40, the apple begins multiplying the winning lines in which it appears. If a line of mixed apples is formed, the multiplier associated with each of the apples forming the line multiplies the prize value for a Whole Apple line 41. For example, if a line is formed of an Apple Two Bites, an Apple Core and an Apple Tree, the prize value of one (1) 41 is multiplied by two by the Apple Two Bites, by three by the Apple Core and by five by the Apple Tree for a prize of thirty credits (1 credit× 2×3×5=30 credits).

Figure 7:
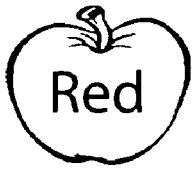
FIG. 7 is an evolving pay table for a game wherein the evolution trigger is an ESU display without using predetermined thresholds.
Figure 7:
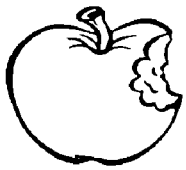
Figure 7:
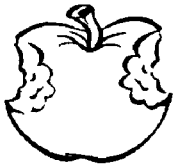
Figure 7:
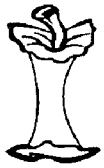
Figure 7:
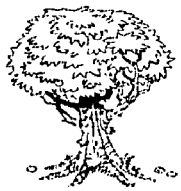
Figure 8A:
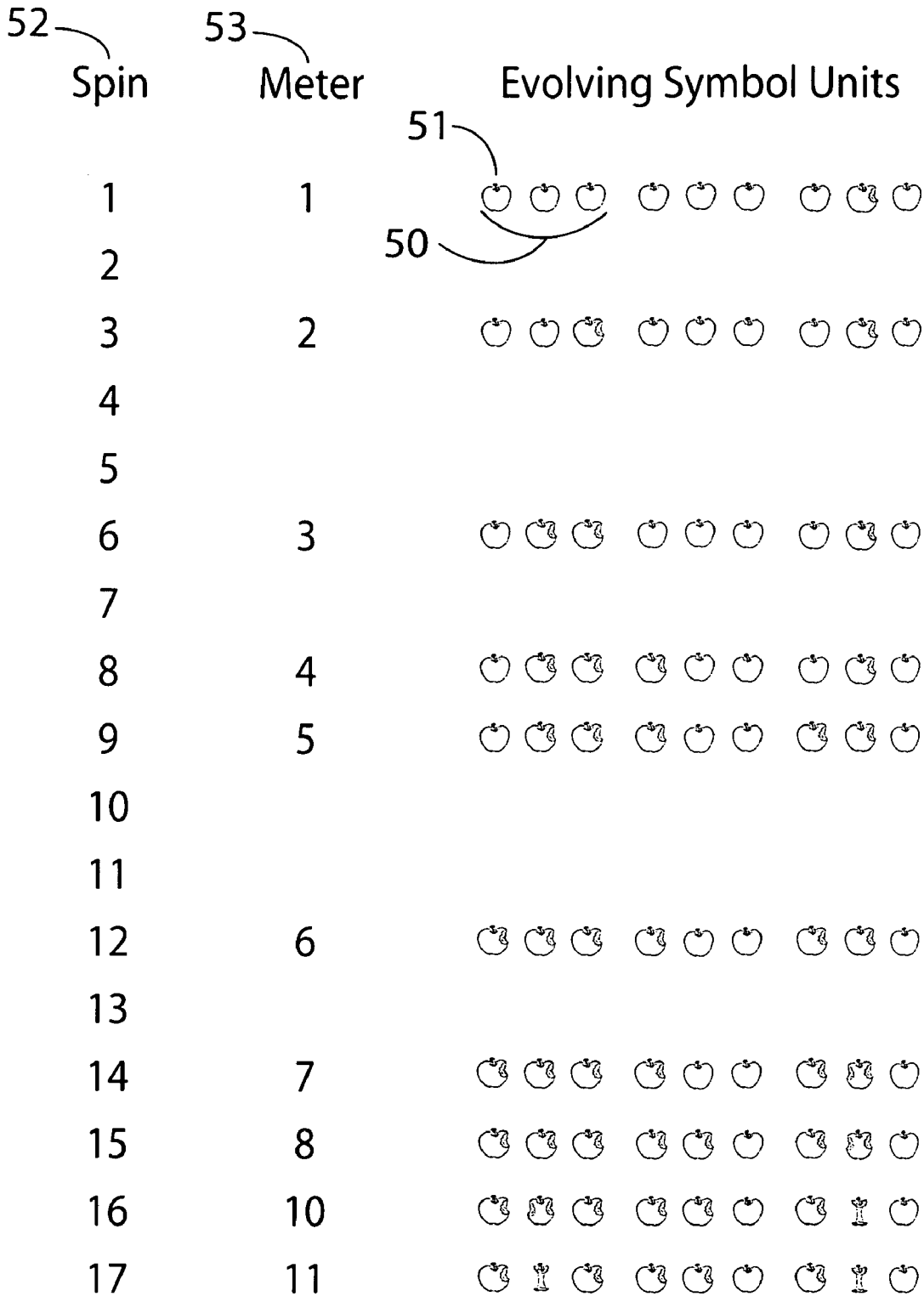
FIG. 8 is an evolution table for a game applying the pay table of FIG. 7.
Figure 8B:
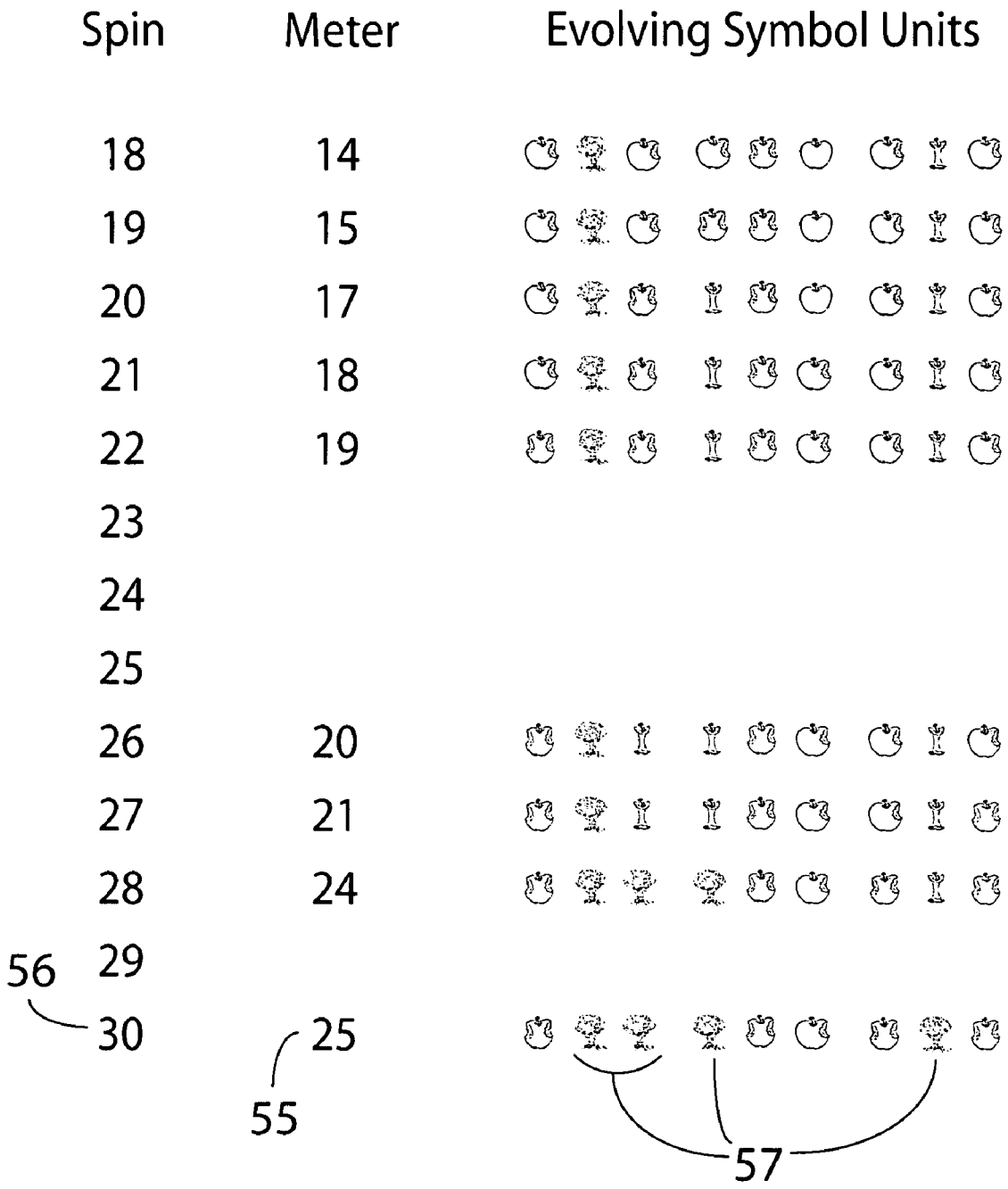

The evolution may be triggered by an event other than reaching a predetermined threshold. In a preferred embodiment, the evolution is triggered by the display of an ESU and does not depend at all on predetermined thresholds. The meter value determines the end of the evolution process and not its rate. Accordingly, when the meter reaches a predetermined value, the ESUs stop evolving and the meter is reset to zero when the final feature, usually a second screen bonus, is triggered or when the player leaves the game. FIG. 7 is an evolving symbol pay table for a game applying this embodiment, while FIG. 8 illustrates an example of the evolution of the ESUs. The evolution stops when the meter reaches a value of twenty-five (25) 45. Each group of three apples 50 represents the three ESUs on a reel, each apple 51 being a specific ESU. On each spin 52, it is determined whether an apple is present or not. If an apple is displayed on the screen, the meter value 53 is increased by one and this apple evolves to the subsequent status. When the meter reaches a value of twenty-five (25) 55, the evolution stops and the apples remain at the status they reached so far, and this until the meter reset to zero. In this example, the meter reaches twenty-five (25) 55 in thirty (30) spins 56. At that moment, there are two Apple Trees on the first reel and one on each of the second and third reels 57. The player has a chance of winning a progressive jackpot by forming a line of Apple Trees, but the next play session may result in an evolution wherein a line of Apple Trees would be impossible to form. This embodiment has the advantage of offering a lot of action to the player since the ESUs evolve at a rapid rate, while possibly awarding a big progressive jackpot.

Figure 9:
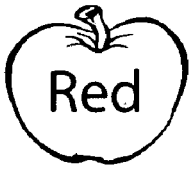
FIG. 9 is an evolving symbol pay table for a game wherein the evolution trigger is an ESU display using predetermined thresholds.
Figure 9:
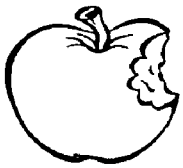
Figure 9:
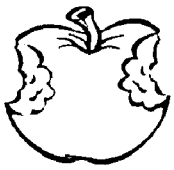
Figure 9:
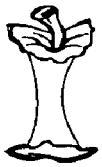
Figure 9:
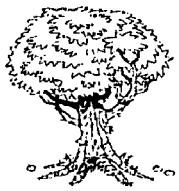

Another embodiment combines the display of at least one ESU and meter thresholds to evolve the ESU. When an ESU appears on the screen, it is determined whether it can evolve to the subsequent status according to its status and the meter thresholds. Even though the meter thresholds determined whether or not an evolution might in fact apply, they are not the evolution trigger; the display of at least one ESU is the evolution trigger. For example, in a game where the meter gathers spins and uses the evolution symbol pay table of FIG. 9, the first spin comprises a Green Apple on the first reel. As soon as the reels stop, a unit is added to the meter. The Green Apple becomes a Red Apple since the threshold to evolve to a Red Apple is one (1). On the second spin, two Green Apples appear on the screen and they are evolved to Red Apples. The meter is now at two (2). On the fourth spin, a Red Apple and a Green Apple appear on the screen. The Green Apple evolves to a Red Apple but the Red Apple remains at this status since the meter has not reached the threshold to evolve to Apple One Bite 60 yet. And so on until a line of Apple Trees occurs, which triggers an enhanced pay table 61 (all winning combination prizes are doubled and some are tripled) for a predetermined number of spins or length of time and reset the meter to zero (0).

None of the precedent embodiments requires the use of a random number generator (RNG); they all describe games wherein all ESUs meeting the conditions to evolve, evolve to the subsequent status. However, more flexibility and volatility may be added to the game by using a RNG to determine how many and which of the ESUs evolve upon occurrence of the evolution trigger. In this method, even though the criteria to evolve ESUs are met, chances are that not all of the ESUs meeting the evolution conditions will evolve, or they will not all evolve at the same rate.

Figure 10:
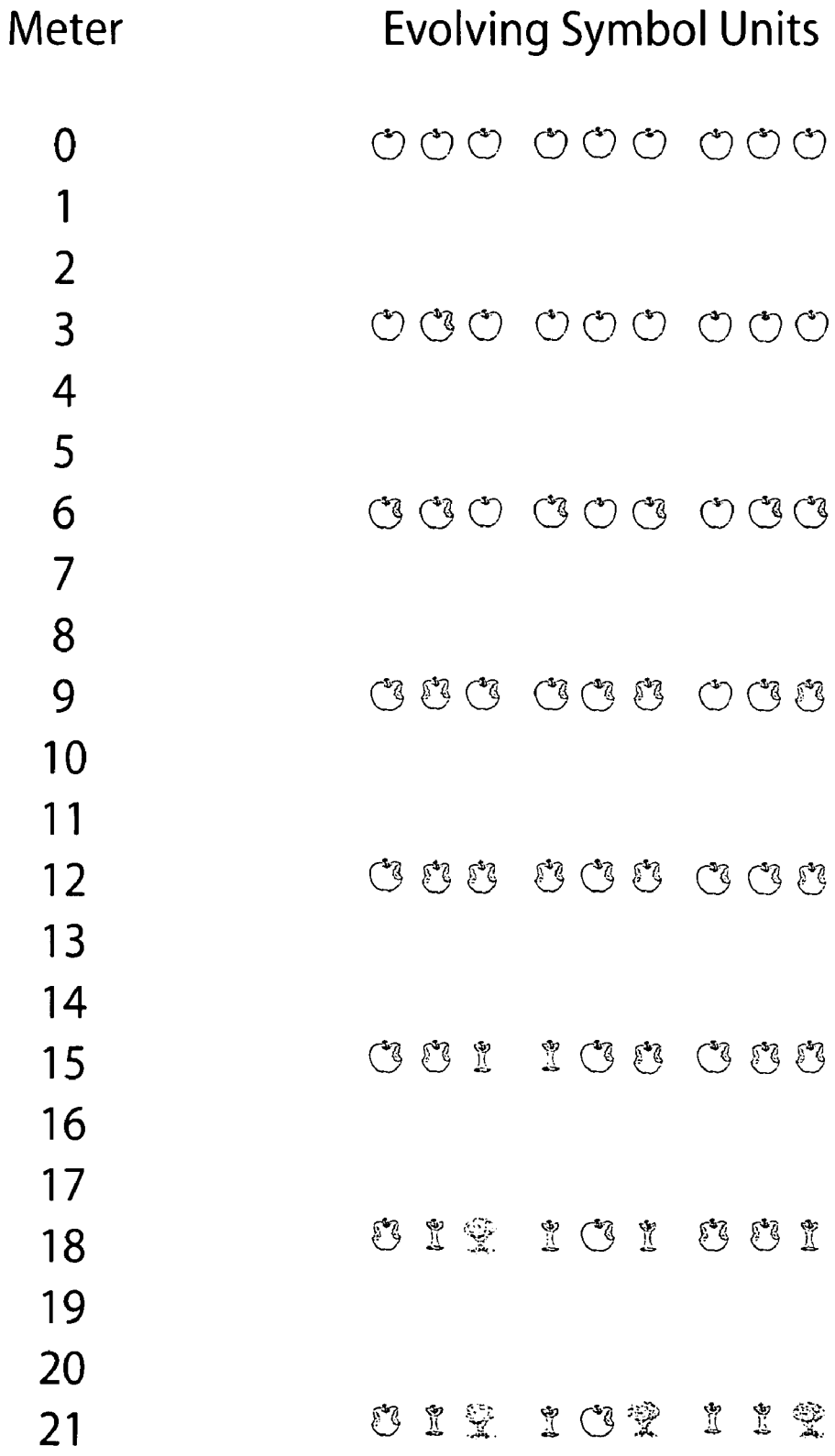
FIG. 10 is an evolution table for a game using a random number generator to evolve ESUs.

A first embodiment is to randomly determine how many and which ESUs in the whole population will evolve upon occurrence of the evolution trigger. FIG. 10 illustrates an evolution table of a game wherein the evolution trigger is the gathering of three units on the meter since the last evolution trigger, upon which a RNG determines whether the ESUs evolve or not. A random number is generated for each ESU and if this random number meets predetermined or evolving conditions (being higher than a fixed or evolving value for example), the ESU evolves to the subsequent status. Thus, each ESU has a chance of evolving.

On the other hand, a preliminary condition may be set to determine a sub-population of the ESUs wherein only the ESUs part of this sub-population have a chance to evolve. For example, a game wherein only the ESUs displayed on the screen at the moment of the evolution trigger has a chance to evolve. The evolution trigger occurs when five (5) units have been gathered on the meter since the last evolution trigger. An RNG determines how many of the displayed ESUs evolve. Naturally, the number of ESUs to evolve varies from none to all displayed. Then, the RNG determines which of the ESUs will evolve.

Another example of preliminary condition may be that the ESU can evolve to the subsequent status according to the meter value and the evolutions thresholds. For example, each time the meter value is raised by one, it is determined, for each ESU, whether or not the evolution to the subsequent level is possible. Afterward, a RNG randomly determines, for each ESU that can evolve, whether or not it actually evolves.

It should be noted that the present invention can be carried out as a method, can be embodied in a system, a computer readable medium or an electrical or electromagnetic signal.

The embodiments of the invention described above are intended to be exemplary only. The scope of the invention is therefore intended to be limited solely by the scope of the appended claims.

We claim

1. A method of operating a game being provided to a player on a gaming machine comprising the steps of:

displaying on the gaming machine a line game comprising symbols organised according to a line game structure;

operating a meter displayed as at least three different statuses of an evolving symbol displayed according to a predetermined order, said evolving symbol being part of said symbols organised according to said line game structure, each occurrence of said evolving symbol in said line game comprising an Evolving Symbol Unit (ESU);

triggering an evolution to a subsequent status according to said predetermined order of one or more of said ESUs upon reaching of a predetermined threshold by said meter; and triggering a feature on the gaming machine based on at least one of said statuses.

2. The method of claim 1, wherein the meter is used to gather occurrences of one of (1) a predetermined symbol; (2) a predetermined combination of symbols; (3) an event dependent of a game outcome; and (4) an event independent of a game outcome.

3. The method of claim 2, wherein the event dependent of the game outcome comprises (1) a winning outcome; (2) a losing outcome; or (3) a prize value.

4. The method of claim 2, wherein, when the meter gathers occurrences of an event independent of a qame outcome, the event independent of the game outcome comprises (1) a spin; (2) an elapsed length of time; or (3) a bet value.

5. The method of claim 1, wherein the number of evolving ESUs is randomly selected.

6. The method of claim 1, wherein the evolving ESUs are randomly selected.

7. The method of claim 1, wherein the evolving ESUs are those displayed when the evolution trigger occurs.

8. The method of claim 1, wherein all the evolving ESUs evolve at the same rate.

9. The method of claim 1, wherein the feature triggered in the game by said evolving symbol comprises (1) a change in the symbol prize value; (2) a new pay table; (3) a bonus payout; (4) a wild feature; (5) an on-screen bonus; or (6) a second-screen bonus.

10. The method of claim 9, wherein the meter is used to gather occurrences of (1) an event dependent of the game outcome; or (2) an event independent of the game outcome, wherein said event dependent of the game outcome comprises (1) a predetermined symbol; (2) a predetermined combination of symbols; (3) a winning outcome; (4) a losing outcome; or (5) a prize value; and said event independent of the game outcome comprises (1) a spin; (2) a length of time; or (3) a bet value.

11. The method of claim 9, wherein said evolving symbol occurs on a reel, each occurrence of said evolving symbol comprising an Evolving Symbol Unit (ESU) and wherein at least one of said ESUs evolve upon occurrence of an evolution trigger.

12. A game apparatus comprising:

a meter gathering occurrences of a predetermined event;

a display controller displaying a line game comprising symbols organised according to a game structure and said meter as at least three different statuses of an evolving symbol displayed according to a predetermined order, part of said symbols organised according to said game structure, and thus according at least in part to a value of said meter, each occurrence of said evolving symbol in said line game comprising an Evolving Symbol Unit (ESU); and an evaluation means triggering an evolution to a subsequent status according to said predetermined order of one or more of said ESUs upon reaching of a predetermined threshold by said meter and triggering a feature in said line game, based on at least one of said statuses.

13. The method of claim 1, wherein the meter is for measuring a value and further wherein the at least three statuses depend at least in part on the value of the meter.

* * * * *